US008391762B2

(12) United States Patent
Kagawa

(10) Patent No.: US 8,391,762 B2
(45) Date of Patent: Mar. 5, 2013

(54) FIXING DEVICE AND IMAGE FORMING APPARATUS INCLUDING THE SAME

(75) Inventor: Toshiaki Kagawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 311 days.

(21) Appl. No.: 12/833,029

(22) Filed: Jul. 9, 2010

(65) Prior Publication Data

US 2011/0052279 A1 Mar. 3, 2011

(30) Foreign Application Priority Data

Aug. 28, 2009 (JP) ..... 2009-198449

(51) Int. Cl.
*G03G 15/20* (2006.01)

(52) U.S. Cl. ..... 399/329

(58) Field of Classification Search ..... 399/328, 399/329

See application file for complete search history.

(56) References Cited

U.S. PATENT DOCUMENTS

| | | | | |
|---|---|---|---|---|
| 6,243,559 | B1 | 6/2001 | Kurotaka et al. | |
| 6,864,461 | B2 | 3/2005 | Okabayashi et al. | |
| 8,107,868 | B2 * | 1/2012 | Kimura | 399/329 |
| 2004/0245235 | A1 | 12/2004 | Kishi et al. | |
| 2005/0232664 | A1 * | 10/2005 | Tomita | 399/329 |
| 2007/0116484 | A1 | 5/2007 | Kishi et al. | |
| 2007/0189817 | A1 | 8/2007 | Kagawa | |
| 2009/0074441 | A1 | 3/2009 | Sato | |
| 2009/0136274 | A1 * | 5/2009 | Kobayashi | 399/329 |

FOREIGN PATENT DOCUMENTS

| | | | |
|---|---|---|---|
| CN | 1557112 | A | 12/2004 |
| JP | 10-307496 | A | 11/1998 |
| JP | 2002-214951 | A | 7/2002 |
| JP | 2003-287969 | A | 10/2003 |
| JP | 2006-293051 | A | 10/2006 |
| JP | 2007-212896 | A | 8/2007 |
| JP | 2009-069603 | A | 4/2009 |

* cited by examiner

*Primary Examiner* — Walter L Lindsay, Jr.
*Assistant Examiner* — Frederick Wenderoth
(74) *Attorney, Agent, or Firm* — Renner, Otto, Boisselle & Sklar, LLP

(57) ABSTRACT

A fixing device of this invention includes: a fixing belt; a heating member for heating the fixing belt; a retaining member having (i) a convex surface which is curved and is in contact with an inner surface of the fixing belt and (ii) a flat surface which is opposite to the convex surface; and a ceramic heater provided on the flat surface of the retaining member. Therefore, the fixing device of this invention is excellent in safety and is capable of reducing a warm-up time.

10 Claims, 7 Drawing Sheets

FIXING DEVICE AND IMAGE FORMING APPARATUS INCLUDING THE SAME

This Nonprovisional application claims priority under 35 U.S.C. §119(a) on Patent Application No. 2009-198449 filed in Japan on Aug. 28, 2009, the entire contents of which are hereby incorporated by reference.

TECHNICAL FIELD

The present invention relates to a fixing device. Particularly, the present invention relates to a fixing device including a ceramic heater and to an image forming apparatus including the fixing device.

BACKGROUND ART

Fixing devices employing a heat roller fixing method are widely used as fixing devices for use in electrophotographic image forming apparatuses such as copy machines and printers. The fixing device employing the heat roller fixing method includes (i) a pair of rollers (a fixing roller and a pressure roller) which press each other and (ii) heating means made of, e.g., a halogen heater, the heating means being disposed within both or either one of the pair of the rollers. The heating means heats the pair of rollers to a predetermined temperature (a fixing temperature). After that, a recording paper sheet on which an unfixed toner image is formed is carried to a pressure area (a fixing nip area) between the pair of rollers, and then the recording paper sheet is caused to pass through the pressure area. Thus, the unfixed toner image is fixed on the recording paper sheet due to heat and pressure applied thereto.

Incidentally, a fixing device included in a color image forming apparatus generally uses an elastic roller, which is a fixing roller provided with, on its surface, an elastic layer made from silicon rubber or the like. In the case where the elastic roller is used as the fixing roller, a surface of the fixing roller elastically deforms according to an uneven surface of an unfixed toner image and comes in contact with the toner image so as to cover the toner image. This makes it possible to favorably fix, by using heat, a color unfixed toner image whose toner amount is larger than that of a monochrome unfixed toner image. Further, due to strain release of the elastic layer which occurs in the fixing nip area, it is possible to improve releasing property with respect to color toner, which is more likely to offset than monochrome toner. Furthermore, the fixing nip area has a nip shape protruding upward (i.e., toward the fixing roller side), that is, a so-called inverse nip shape. This makes it possible to more favorably separate a recording paper sheet from the fixing roller, thereby allowing the recording paper sheet to be separated without use of any separation means such as a separation claw (self-stripping). This prevents insufficient image formation which is caused by the separation means.

Now, in order that the fixing apparatus included in such the color image forming apparatus responds to a higher process speed, the fixing nip area needs to have a greater nip width. Examples of means for increasing the nip width encompass: a method of increasing a thickness of the elastic layer of the fixing roller; and a method of increasing a diameter of the fixing roller.

However, a fixing roller having a thicker elastic layer causes the following problem: The elastic layer has a low heat conductivity. Therefore, in a case where the heating means is provided within the fixing roller having the thicker elastic layer as in the conventional fixing devices, increasing a process speed results in insufficient heat supply, so that a temperature of the fixing roller does not follow the increased process speed. Meanwhile, increasing the diameter of the fixing roller reduces curvatures of the rollers forming the fixing nip area, thereby increasing the fixing nip area. Increasing the diameter of the fixing roller, however, requires the rollers to increase their heat capacities, thereby causing problems of an extended warm-up time and increased electric power consumption.

In order to solve these problems, recently, as the fixing device included in the color image forming apparatus, Patent Literature 1 discloses a fixing device employing an external belt heating fixing method that uses an external heating belt to heat a fixing roller from the outside, for example. The fixing device employing the external belt heating fixing method can efficiently heat the fixing roller from the outside, thereby reducing a warm-up time. Further, for example, Patent Literature 2 discloses a fixing device (belt fixing device) employing a belt fixing type. In the belt fixing device, a heating roller, which is heating means, is provided outside a fixing roller, a fixing belt is set between the fixing roller and the heating roller, and the fixing roller and a pressure roller press each other via the fixing belt. In the belt fixing device, the fixing belt having a small heat capacity is heated. This can reduce a warm-up time. Further, with any of these fixing methods, it is not necessary to incorporate a heating source such as a halogen lamp into the fixing roller. This makes it possible to increase a thickness of a low-hardness elastic layer made from sponge rubber and/or the like, thereby securing a large nip width.

Furthermore, Patent Literatures 3 and 4, etc. disclose fixing devices (planar heat-generating belt fixing devices) each employing a planar heat-generating belt fixing method. Each of the planar heat-generating belt fixing devices is a belt fixing device provided with a planar heater which curves along heating means. In the planar heat-generating belt fixing device, the heating means has a smaller heating capacity than those of conventional heating rollers. Further, in the planar heat-generating belt fixing device, the planar heater, serving as the heating means, directly generates heat. Thus, compared with the conventional belt fixing methods in which the heat roller is indirectly heated with use of the halogen lamp, the planar heat-generating belt fixing device has improved thermal response, and enables further reduction in a warm-up time and further energy saving.

CITATION LIST

Patent Literature 1
Japanese Patent Application Publication, Tokukai, No. 2007-212896 A (Publication Date: Aug. 23, 2007)
Patent Literature 2
Japanese Patent Application Publication, Tokukaihei, No. 10-307496 A (Publication Date: Nov. 17, 1998)
Patent Literature 3
Japanese Patent Application Publication, Tokukai, No. 2003-287969 A (Publication Date: Oct. 10, 2003)
Patent Literature 4
Japanese Patent Application Publication, Tokukai, No. 2006-293051 A (Publication Date: Oct. 26, 2006)

SUMMARY OF INVENTION

Technical Problem

However, the conventional belt fixing devices and planar heat-generating belt fixing devices have the following problems: The belt fixing device needs a plurality of halogen heaters, serving as a heating source, disposed within the heat roller. This restricts a potential reduction of the diameter of the heating roller. This limits an effect of reduction in the warm-up time.

For the planar heat-generating belt fixing device, the planar heater should be formed so as to be curved. Therefore, mainly proposed as the heater is a flexible polyimide heater (a heater including a polyimide sheet on which a heat generator made of SUS or nichrome is formed by etching). However, if the heater is overdriven due to, e.g., a trouble in temperature control, the polyimide might melt to emit smoke, burn, and/or cause leakage of electricity, for example. Thus, the planar heat-generating belt fixing device bears safety problems. For this reason, the planar heat-generating belt fixing devices have never been put into practice use. Further, mainly proposed as the planar heat-generating belt fixing device is the one which employs, as a base, a belt fixing device including a planar heater whose shape corresponds to a semicylindrical half of a heating roller. Therefore, a heat capacity of the planar heater is not significantly reduced from that of a heating roller of the belt fixing device. That is, the planar heat-generating belt fixing device provides a limited effect of reduction in a warm-up time.

The present invention was made in view of the above problems. An object of the present invention is to provide: a fixing device which is excellent in safety and which is capable of reducing a warm-up time; and an image forming apparatus using the fixing device.

Solution to Problem

In order to solve the foregoing problems, a fixing device of the present invention includes: a fixing member; a heating member; a fixing belt which is endless, the fixing belt being rotatably suspended by the fixing member and the heating member, the fixing belt being heated by the heating member; and a pressure member pressing the fixing member via the fixing belt, the pressure member forming, in an area where the pressure member presses the fixing member, a fixing nip area together with the fixing belt, the fixing device fixing an unfixed image on a recording material onto the recording material, while the recording material passes through the fixing nip area, the heating member including: a retaining member having (i) a convex surface which is curved and is in contact with an inner surface of the fixing belt and (ii) a flat surface which is opposite to the convex surface; and a ceramic heater provided on the flat surface of the retaining member.

Advantageous Effects of Invention

With the above configuration, the fixing belt employs the ceramic heater as heating means. Therefore, even if a trouble or the like occurs in control of a fixing temperature, this fixing belt has a quite small possibility of emitting smoke, burning, causing leakage of electricity, etc., unlike in the case involving use of the polyimide heater. Thus, this fixing belt is excellent in safety. Further, via the retaining member having (i) the convex surface which is curved and is in contact with the inner surface of the fixing belt and (ii) the flat surface which is opposite to the convex surface, heat of the ceramic heater provided on the flat surface of the retaining member is transferred to the fixing belt. Therefore, compared with the conventional fixing devices employing the heat roller, the fixing device of the present invention is more excellent in heat transfer, and can reduce a war-up time. In addition, in the fixing device of the present invention, the ceramic heater does not directly slide with the fixing belt. This elongates lives of the ceramic heater and the fixing belt.

DESCRIPTION OF EMBODIMENTS

An embodiment of the present invention will be described with reference to the drawings. The following will give specific descriptions on: an embodiment of a fixing device of the present invention; and an embodiment of an image forming apparatus including the fixing device.

(Image Forming Apparatus)

Figure 2:
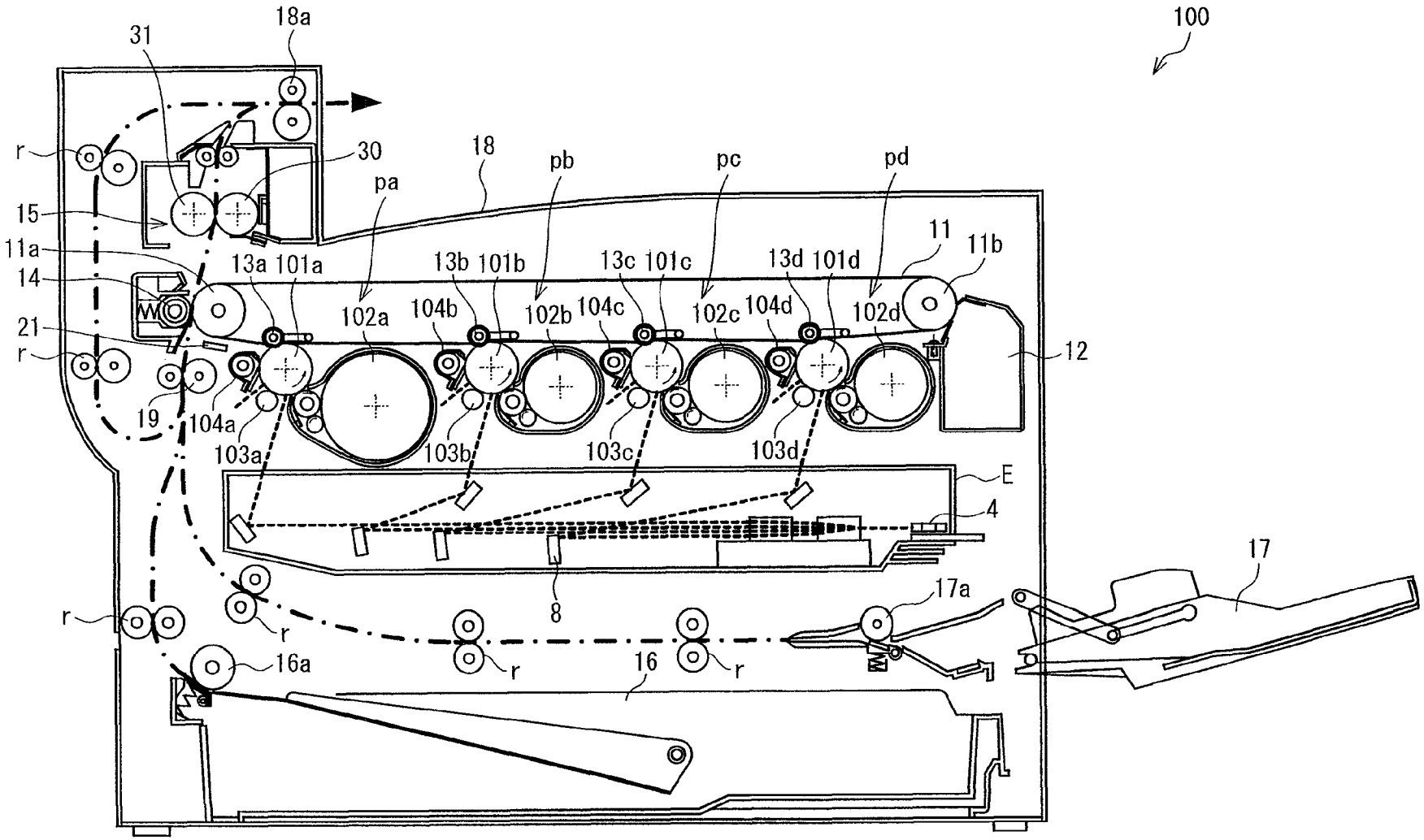
FIG. 2 is a view schematically illustrating configuration of an image forming apparatus of an embodiment of the present invention.

Firstly described is a configuration of an image forming apparatus of the present invention. FIG. 2 is a cross-section view schematically illustrating a configuration of an image forming apparatus 100 of the present embodiment. The image forming apparatus 100 is a so-called tandem type image forming apparatus, printer employing an intermediate transfer method, and color complex machine capable of forming full color images. In the present embodiment, the description mainly deals with cases where an image forming apparatus of the present invention is applied to a color multifunction peripheral/printer or a color printer. However, an image forming apparatus of the present invention is also applicable to a monochrome multifunction peripheral/printer or a monochrome printer.

As shown in FIG. 2, the image forming apparatus 100 includes: an optical system unit E; four visible image forming units pa, pb, pc, and pd; an intermediate transfer belt 11; a second transfer unit 14; a fixing device (fixing unit) 15; an internal paper feeding unit 16; and a manual paper feeding unit 17.

The visible image forming unit pa includes a photoreceptor 101*a*, serving as an image bearing member, around which a charging device 103*a*, a developing unit 102*a*, and a cleaning unit 104*a* are disposed. Further, a first transfer unit 13*a* is disposed via the intermediate transfer belt 11. The other three visible image forming units pb, pc, and pd have the same configuration as that of the visible image forming unit pa. Members having the same functions are given the same numbers and letters (b, c, d) of their corresponding visible image forming units. The visible image forming units pa, pb, pc, and pd contain toners of yellow (Y), magenta (M), cyan (C), and black (B), respectively.

The optical system unit E is disposed so that a beam from a light source 4 reaches the four photoreceptors 101*a*, 101*b*, 101*c*, and 101*d*. The optical system unit E is configured to be supplied with pixel signals respectively corresponding to a yellow component, a magenta component, a cyan component, and a black component in image data. Beams respectively corresponding to the image signals supplied are emitted from the light source 4. Then, the beams are reflected by a mirror 8, so that the electrically-charged photoreceptors 101*a*, 101*b*, 101*c*, and 101*d* are exposed the beams. Thus, electrostatic latent images are formed.

The intermediate transfer belt 11 is disposed without being bent, thanks to tension rollers 11*a* and 11*b*. Further, on the side of the tension roller 11*b*, a waste toner box 12 used to collect toner remaining on the intermediate transfer belt is disposed so as to be in contact with the intermediate transfer belt 11; on the side of the tension roller 11*a*, the second transfer unit 14 is disposed so as to be in contact with the intermediate transfer belt 11.

The fixing device 15 is a device by which an unfixed toner image formed on a surface of a recording paper sheet P is fixed on the recording paper sheet P under heat and pressure. The fixing device 15 includes a fixing roller 30 and a pressure roller 31, which are caused to press each other with a predetermined pressure by means of pressure means (not illustrated) and are disposed on the downstream side of the second transfer unit 14. The present embodiment includes the fixing device 15 employing the planar heat-generating belt fixing method, which will be described in detail later.

The image forming apparatus 100 forms an image as follows: A surface of the photoreceptor 101*a* is uniformly charged by the charging device 103*a*, after which the surface of the photoreceptor 101*a* is subjected to laser exposure by the optical system unit E according to image information, so that an electrostatic latent image is formed. The charging device 103*a* of the present embodiment employs a charging roller method in order to charge the surface of the photoreceptor 101*a* uniformly while preventing generation of ozone as much as possible. Thereafter, the developing unit 102*a* develops a toner image according to the electrostatic latent image on the photoreceptor 101*a*. The toner image which has been made visible is transferred onto the intermediate transfer belt 11 by the first transfer unit 13*a* to which a bias voltage having a polarity reverse to that of the toner is applied.

The other three visible image forming units pb, pc, and pd operate in the same manner, so as to sequentially perform image transfer onto the intermediate transfer belt 11. A toner image thus formed on the intermediate transfer belt 11 is charged by a pre-transfer charging device 21 just before the second transfer unit 14. Then, the toner image on the intermediate transfer belt 11 is carried to the second transfer unit 14. A recording paper sheet P is fed by another operation through the paper feeding roller 16*a* of the internal paper feeding unit 16 or through the paper feeding roller 17*a* of the manual paper feeding unit 17, and then is carried by carrying rollers r and 19. Subsequently, the second transfer unit 14 applies to the recording paper sheet P a bias voltage having a polarity reverse to that of the toner, so that the toner image is transferred onto the recording paper sheet P. The unfixed toner image on the recording paper sheet P is carried to the fixing device 15. The unfixed toner image is adequately heated and pressurized while passing through the fixing device 15, so as to be melted and fixed on the recording paper sheet. Then, the recording paper sheet P having been subjected to the toner image fixing process performed by the fixing device 15 is discharged to the outside of the image forming apparatus 100 by the carrying roller 18*a*. Thus, the image forming process is completed.

(Fixing Device)

Figure 1:
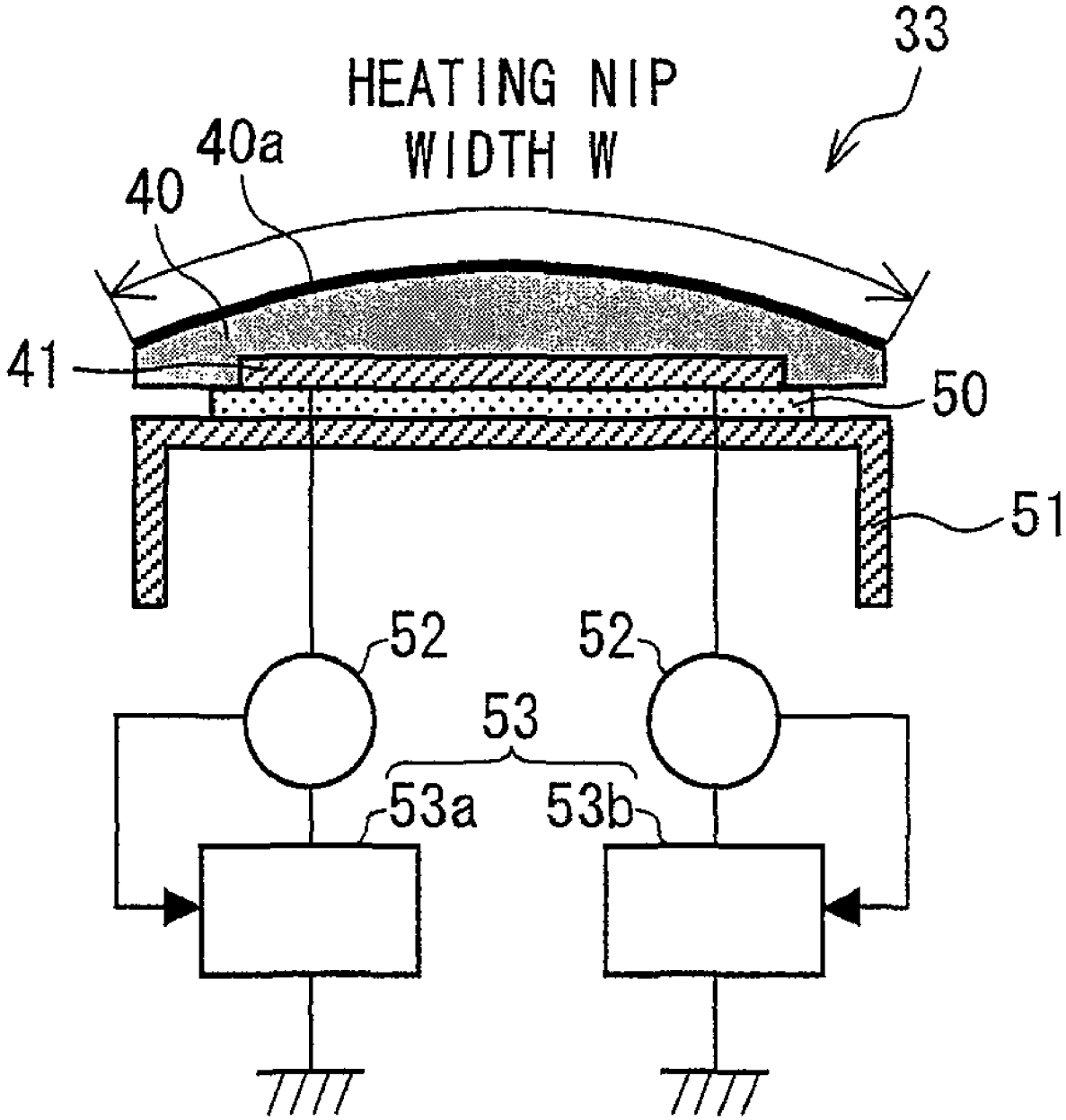
FIG. 1 is an enlarged view illustrating a cross-sectional configuration of an area of a fixing device of an embodiment of the present invention in which area a heating member is formed.
Figure 3:
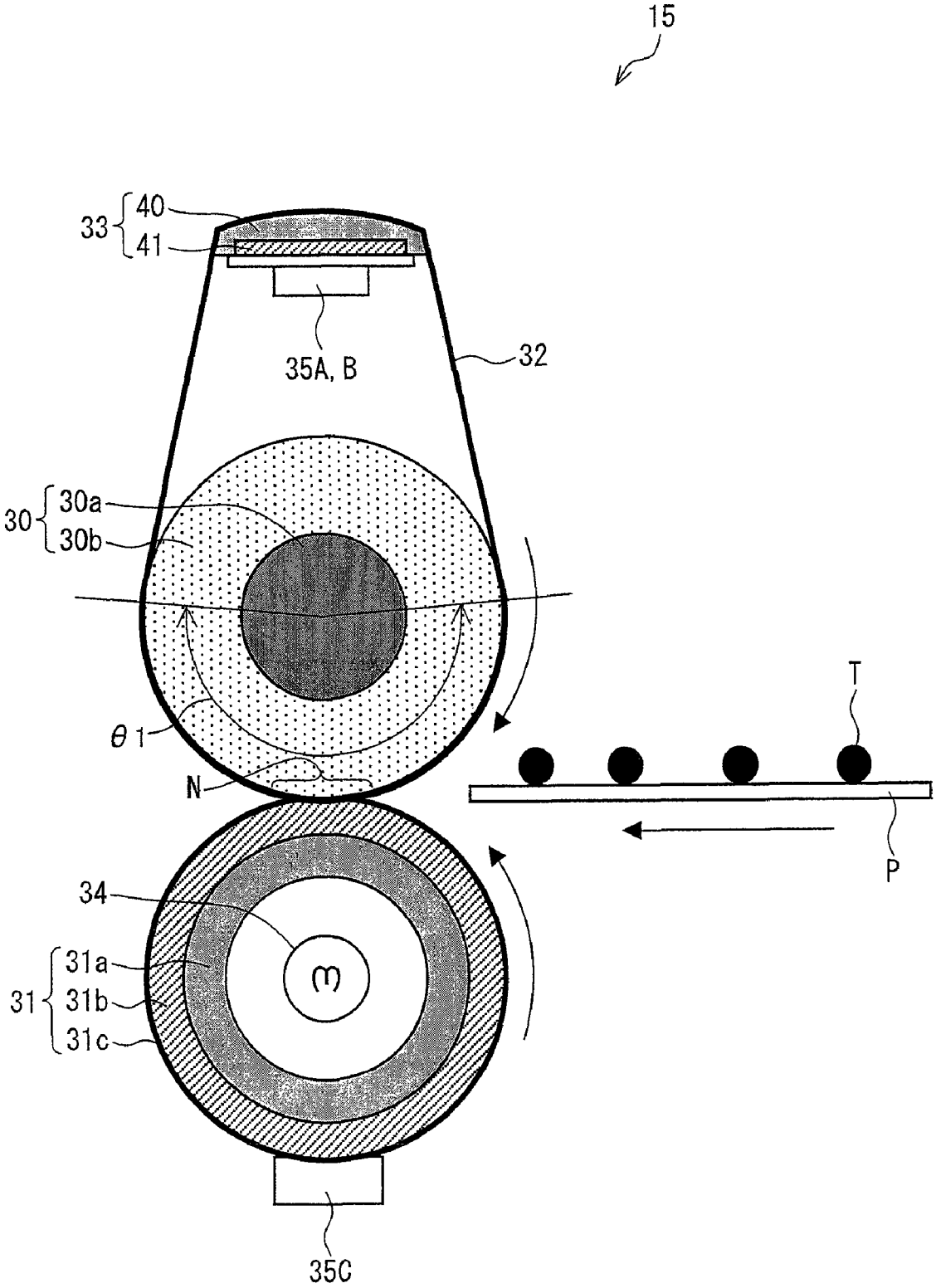
FIG. 3 is a cross-section view illustrating a configuration of the fixing device.

Next, the following will describe a configuration of the fixing device 15 of the present embodiment with reference to FIGS. 1 and 3. FIG. 1 is a cross-section view illustrating a configuration of heating means included in the fixing device 15. FIG. 3 is a cross-section view illustrating the configuration of the fixing device 15.

As shown in FIG. 3, the fixing device 15 includes: the fixing roller (fixing member) 30; the pressure roller (pressure member) 31; a fixing belt 32 which is endless; the heating means including a heating member 33 by which the fixing belt is suspended and heated; a heater lamp 34, which is a heat source for heating the pressure roller 31; and thermistors 35A, 35B, and 35C, which are temperature sensors constituting temperature detecting means for detecting respective temperatures of the fixing belt 32 and the pressure roller 31.

The fixing device 15 fixes an unfixed toner image (toner T) formed on a surface of a recording paper sheet P, onto the recording paper sheet P under heat and pressure. The fixing device 15 is a fixing device employing a planar heat-generating belt fixing method in which (i) a toner image on a recording paper sheet P is directly heated by the fixing belt 32 and (ii) the heating member 33 is not disposed in a fixing nip area N. The unfixed toner image is formed by, for example, toner contained in a nonmagnetic single-component developer (nonmagnetic toner), a magnetic developer (magnetic toner), or a nonmagnetic two-component developer (nonmagnetic toner and carrier).

The fixing roller 30 and the pressure roller 31 press each other with a predetermined load (e.g., 392 N in the present embodiment) so as to form a fixing nip area N (an area where the fixing roller 30 and the pressure roller 31 are in contact with each other) therebetween. In the present embodiment, a nip width (a width of the fixing nip area N in a direction in which a recording paper sheet is carried) is set to 7.5 mm. However, the present invention is not limited to this value. A recording paper sheet P on which an unfixed toner image is formed is carried to the fixing nip area N, and is caused to pass through the fixing nip area N, so that the unfixed toner image is heated and melted to be fixed on the recording paper sheet P. While the recording paper sheet P is passing through the fixing nip area N, the fixing belt 32 comes in contact with a surface of the recording paper sheet P on which surface the toner image is to be formed, whereas the pressure roller 31 comes in contact with a surface of the recording paper sheet P which surface is opposite to the surface on which the toner image is to be formed.

The fixing roller 30 is pressed onto the pressure roller 31 via the fixing belt 32 so as to form the fixing nip area N, and is driven and rotated by a friction resistance with an outer surface of the fixing belt 32, so as to carry the fixing belt 32. The fixing roller 30 may be, e.g., the one having a two-layer configuration in which a core 30*a* and an elastic layer 30*b* are formed in this order from the inside. For the core 30*a*, metal such as iron, stainless steel, aluminum, copper, or an alloy thereof is used, for example. For the elastic layer 30*b*, a rubber material which has a heat resistance and is capable of elastic deformation is suitable, examples of which encompass silicon rubber and fluororubber. In the present embodiment, the fixing roller 30 has a diameter of 30 mm, the core 30*a* is made of a hollow or solid stainless steel having a diameter of 15 mm, and the elastic layer 30*b* is made of a silicon sponge rubber having a thickness of 7.5 mm. However, the present invention is not limited to these values.

The pressure roller 31 may be, e.g., the one having a three-layer configuration in which a core 31*a*, an elastic layer 31*b*, and a releasing layer 31*c* are formed in this order from the inside. For the core 31*a*, metal such as iron, stainless steel, aluminum, copper, or an alloy thereof is used, for example. For the elastic layer 31*b*, a rubber material which has a heat resistance and is capable of elastic deformation is used, examples of which encompass silicon rubber and fluororubber. For the releasing layer 31*c*, fluororesin such as PFA (a copolymer of tetrafluoroethylene and perfluoroalkylvinylether) or PTFE (polytetrafluoroethylene) is suitable. In the present embodiment, the pressure roller 31 has a diameter of 30 mm, the core 31*a* is made of an iron alloy (STKM) having a diameter of 28 mm and a thickness of 1 mm, the elastic layer 31*b* is made of silicon solid rubber having a thickness of 1 mm, and the releasing layer 31*c* is made of a PFA tube having a thickness of 30 μm.

Further, the pressure roller 31 internally includes the heater lamp 34 for heating the pressure roller 31 from the inside. Control means (not illustrated) supplies an electric power to (i.e., energizes) the heater lamp 34 from a power source circuit (not illustrated), so that the heater lamp 34 emits light and an infrared ray. Then, an inner surface of the pressure roller 31 absorbs the infrared ray and is heated. Consequently, the pressure roller 31 is heated in whole. In the present embodiment, the heater lamp 34 having a rated power of 400 W is used. In order to help the inner surface of the pressure roller 31 absorb an infrared ray emitted by the heater lamp 34, a heat-resistant black painting having favorable absorption properties with respect to a wavelength band of an infrared ray may be applied to the inner surface of the pressure roller 31.

The fixing belt 32 is heated to a predetermined temperature by heat generated by the heating member 33, so as to heat a recording paper sheet P on which an unfixed toner image is formed and which passes through the fixing nip area N. In the present embodiment, the fixing belt 32 has a diameter of 45 mm, is suspended by the heating member 33 and the fixing roller 30, and is wound around the fixing roller 30 at a predetermined angle θ1. The angle θ1 is made by a part of the fixing belt 32 which part is in contact with the fixing roller 30. That is, the angle θ1 is made by two lines respectively extending from a rotational center of fixing roller 30 to two points at which the fixing belt 32 comes off from the surface of the fixing roller 30. In the present embodiment, θ1=185°.

While the fixing roller 30 is rotating, the fixing belt 32 is rotated by the fixing roller 30. For example, the fixing belt 32 may be the one configured as follows: First, on a surface of a hollow cylindrical substrate made of (i) a heat-resistant resin such as polyimide, polyamide, or an aramid resin or (ii) a metal material produced by rolling or electrocasting stainless steel, nickel, etc., an elastomer material (e.g., silicon rubber) excellent in heat resistance and elasticity is formed as an elastic layer. On a surface of the elastic layer, a resin material (e.g., fluororesin such as PFA or PTFE) excellent in heat resistance and releasing properties is formed as a releasing layer. The one having such a three-layer configuration may be used as the fixing belt 32.

The elastic layer and the releasing layer are formed on the side of the outer surface of the fixing belt 32. Note that, in a case where a heat-resistant resin such as polyimide is used for the substrate, fluororesin may be added thereto. The addition of fluororesin can further reduce a friction resistance with the heating member 33, thereby further reducing a sliding load with the heating member 33.

Note that the fixing belt 32 of the present embodiment includes: the substrate made of polyimide having a thickness of 70 μm; the elastic layer made of silicon rubber having a thickness of 150 μm; and the releasing layer made of a PFA tube having a thickness of 20 μm. In addition to the PFA tube, the releasing layer may include a coating made of PFA, PTFE, or the like.

The heating member 33 is in contact with the fixing belt so as to heat the fixing belt 32 to a predetermined temperature. As shown in FIG. 1, the heating member 33 is connected with a power source 53 for supplying a predetermined electric power to the heating member 33. The heating member 33 and the power source 53 constitute the heating means.

The heating member 33 includes a retaining member 40, a ceramic heater 41, a heat insulating sheet 50, and a holding member 51. The retaining member 40 has a cross section having a circular-arc shape. The retaining member 40 has (i) a surface being in contact with the fixing belt 32 and (ii) another surface which is opposite to the surface being in contact with the fixing belt 32 and on which the ceramic heater 41 is formed. A configuration of the ceramic heater 41 will be described in detail later.

The surface of the retaining member 40 which surface is in contact with the inner surface of the fixing belt 32 is a convex surface which is curved, whereas the surface opposite to the convex surface is a flat surface. The retaining member 40 is disposed so that its longitudinal direction corresponds to a width direction of the fixing belt 32. In the present embodiment, the retaining member 40 uses an aluminum alloy excellent in heat conductivity so as to efficiently transfer, to the fixing belt 32, heat generated by the ceramic heater 41. Further, a width (the width of the heating nip area; the heating nip width W) in which the retaining member 40 is in contact with the fixing belt 32 is set to 17.5 mm. Furthermore, on the surface of the retaining member 40 which surface slides with the fixing belt 32, a coating layer 40*a* is formed so as to improve sliding properties of the fixing belt. In the present embodiment, the coating layer 40*a* is a PTFE coating having a thickness of 20 μm. Note that these are presented just as an example.

The ceramic heater 41 is disposed on the surface of the retaining member 40 which surface is opposite to the convex surface of the retaining member 40, i.e., on the surface of the retaining member 40 which surface is opposite to the surface being in contact with the fixing belt 32. In the present embodiment, the ceramic heater 41 is pressurized by the holding member 51 via the heat insulating sheet 50, so as to be fixed onto the retaining member 40.

The holding member 51 is for preventing the heating member 33 from being bent due to tension of the fixing belt 32. In the present embodiment, the holding member is made of a stainless steel material having a thickness of 1 mm, and has a cross section shaped in a substantially U-shape as shown in FIG. 1 so as to secure a strength against the bending.

The heat insulating sheet 50 is for preventing heat generated by the ceramic heater 41 from being released to the holding member 51 as much as possible. In the present embodiment, the heat insulating sheet 50 is made of fluororubber having a thickness of 1 mm.

(Configuration of Heater)

Figure 4:
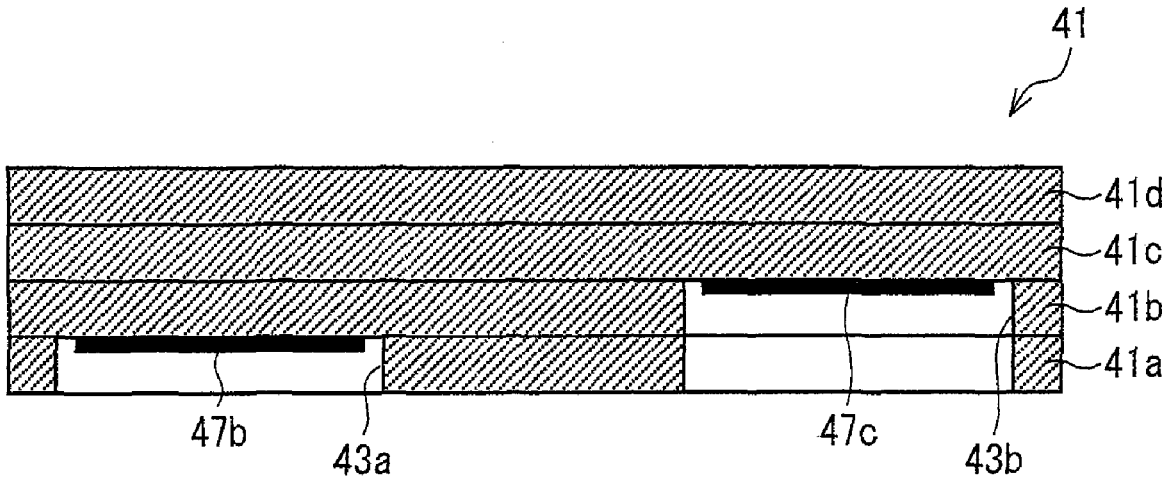
FIG. 4 is a cross-section view of a heater included in the fixing device.
Figure 5:
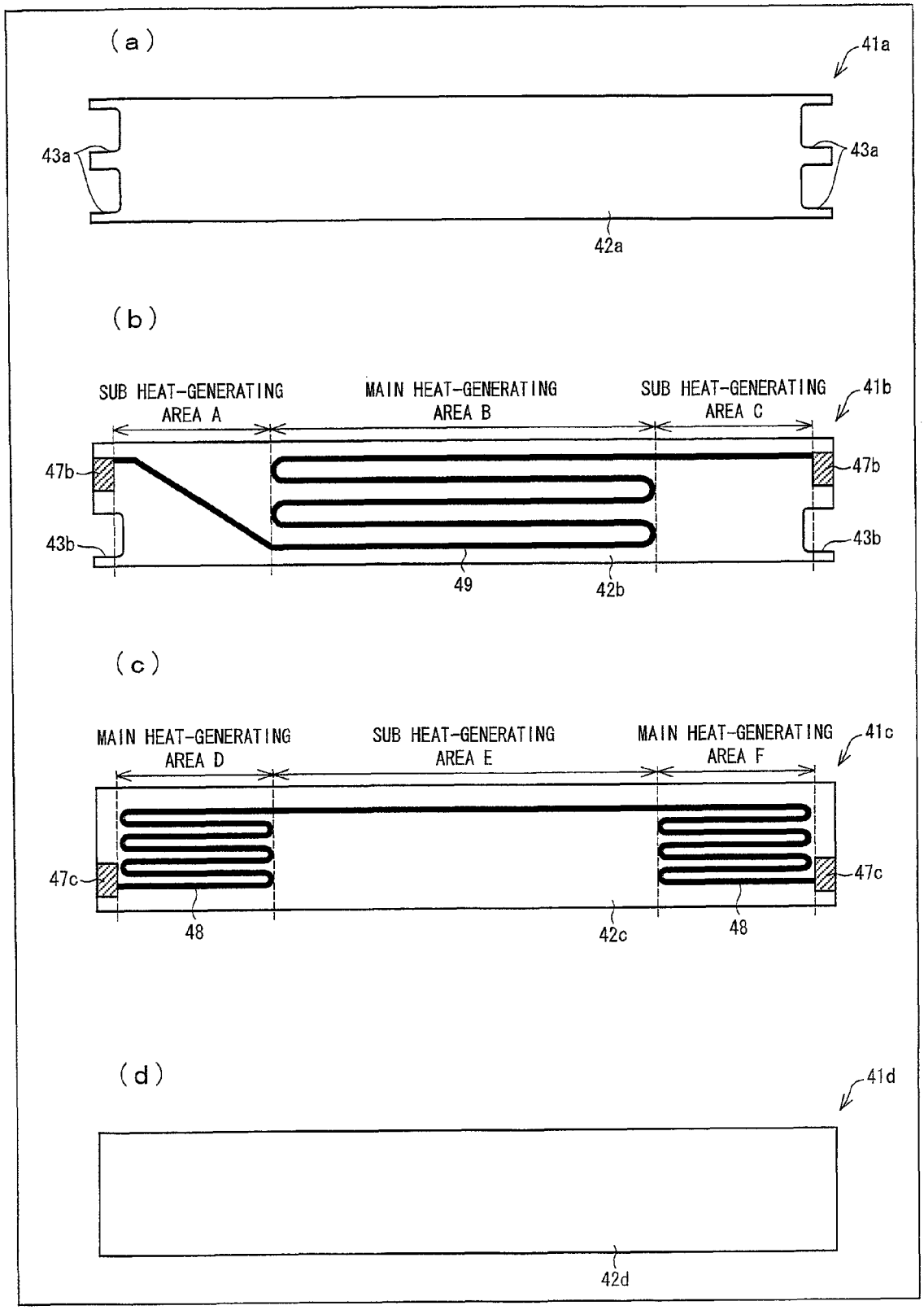
FIG. 5 shows elevation views respectively illustrating configurations of parts of the heater. (*a*) of FIG. 5 shows a protective substrate; (*b*) of FIG. 5 shows a main heater substrate; (*c*) of FIG. 5 shows a sub heater substrate; and (*d*) of FIG. 5 shows a base substrate.

Next, the following will describe a configuration of the ceramic heater 41 included in the fixing device 15, with reference to FIG. 4 and (*a*) to (*d*) of FIG. 5. FIG. 4 is a cross-section view illustrating the configuration of the ceramic heater 41. (*a*) to (*d*) of FIG. 5 are elevation views respectively illustrating a protective substrate 41*a*, a main heater substrate 41*b*, a sub heater substrate 41*c*, and a base substrate 41*d*, which constitute the ceramic heater 41.

In the present embodiment, the ceramic heater 41 is a long-plate-shaped, ceramic heater including foundation substrates (insulating substrates) 42*a* to 42*d* which are made of a ceramic material and to which resistors are formed. The ceramic heater 41 is 12.3 mm in width, 360 mm in length, and 0.8 mm in thickness.

As shown in FIG. 4 and (*a*) to (*d*) of FIG. 5, the ceramic heater 41 is formed into a flat plate including four substrates, the protective substrate 41*a*, the main heater substrate 41*b*, the sub heater substrate 41*c*, and the base substrate 41*d*, which are laminated in this order and bonded to one another. These substrates respectively include, as a base, the foundation substrates 42*a* to 42*d*, each of which may be made of a ceramic material such as high-purity alumina, crystallized glass, forsterite, steatite, or a low temperature co-fired ceramic (LTCC), which is a glass-alumina composite material. A thickness of each of these substrates is 0.2 mm, and a total thickness of the ceramic heater 41 is 0.8 mm.

As shown in (*b*) of FIG. 5, the main heater substrate 41*b* includes a main heat generator 49. The main heat generator 49 is a resistor for causing a main heat-generating area B to emit heat. This main heat-generating area B is a center area of the foundation substrate 42*b* in its longitudinal direction (which corresponds to a longitudinal direction of the ceramic heater 41). The main heat generator 49 is integrally formed on a surface of the foundation substrate (insulating substrate) 42*b*. In the present embodiment, the main heat-generating area B shown in (*b*) of FIG. 5 is 200 mm in width along its longitudinal direction.

A material forming the main heat generator 49 is not limited to any particular kind, as long as the material is the one having electrical conductivity, examples of which encompass gold, tungsten, silver, silver palladium, and stainless steel. However, the material must be the one which is not deformed (e.g., melted) in response to energization and/or heating. In the present embodiment, the main heat generator 49 is formed of a material made of silver palladium. In the present embodiment, the main heat generator 49 is shaped into five parallel band-like heat generators made of a wire which has a width of 0.79 mm and which makes four U-turns in the main heat-generating area B.

Further, the main heater substrate 41*b* is provided with, at both ends, power supply terminal sections 47*b*. The main heat generator 49 formed in the main heat-generating area B is extended along sub heat-generating areas A and C in both side areas of the main heater substrate 41*b*, so as to be connected with the power supply terminal sections 47*b*. A material forming each of the power supply terminal sections 47*b* is not limited to any particular kind, as long as the material is the one having electrical conductivity, examples of which encompass gold, tungsten, silver, silver palladium, and stainless steel. In the present embodiment, each of the power supply terminal sections 47*b* is formed of a material made of silver palladium, as well as the main heat generator 49.

As shown in (*c*) of FIG. 5, the sub heater substrate 41*c* includes sub heat generators 48. The sub heat generators 48 are registers for causing main heat-generating areas D and F to emit heat. The main heat-generating areas D and F are side areas of the foundation substrate (insulating substrate) 42*c* in its longitudinal direction (which corresponds to the longitudinal direction of the ceramic heater 41). In the present embodiment, each of the main heat-generating areas D and F shown in (*c*) of FIG. 5 is 60 mm in width along its longitudinal direction. These sub heat generators 48 are connected with each other in a sub heat-generating area E, which is a center area of the sub heater substrate. The sub heat generators 48 are integrally formed on a surface of the foundation substrate 42*c*.

As well as the main heat generator 49, a material forming each of the sub heat generators 48 is not limited to any particular kind, as long as the material is the one having electrical conductivity, examples of which encompass gold, tungsten, silver, silver palladium, and stainless steel. However, the material must be the one which is not deformed (e.g., melted) in response to energization and/or heating. In the present embodiment, the sub heat generator 48 is formed of a material made of silver palladium, as well as the main heat generator 49. In the present embodiment, each of the sub heat generators 48 is shaped into seven parallel band-like heat generators made of a wire which has a width of 0.44 mm and which makes six U-turns in the main heat-generating area D or F.

Further, the sub heater substrate 41*c* is provided with, at both ends, power supply terminal sections 47*c*, which are respectively connected with the sub heat generators 48. A material forming each of the power supply terminal sections 47*c* is not limited to any particular kind, as long as the material is the one having electrical conductivity, examples of which encompass gold, tungsten, silver, silver palladium, and stainless steel. In the present embodiment, each of the power supply terminal sections 47*c* is formed of a material made of silver palladium, as well as the main heat generator 49.

The protective substrate 41*a* and the main heater substrate 41*b* have, at their both ends in the longitudinal direction, openings for power supply (cavities for power supply) through which the power supply terminal sections are exposed in a state where the four types of substrates are laminated. Specifically, the protective substrate 41*a* has openings 43*a* through which the power supply terminal sections 47*b* and the power supply terminal sections 47*c* are exposed to the foundation substrate 42*a*. The main heater substrate 41*b* has openings 43*b* through which the power supply terminal sections 47*c* are exposed.

For the base substrate 41*d*, the foundation substrate 42*d* having nothing provided is used as it is.

(Method for Producing Heater)

Next, the following will describe a method for producing the ceramic heater 41. In the present embodiment, the heater is produced as follows: First, as the foundation substrates 42*a* to 42*d*, a green sheet made of LTCC having a thickness of 0.2 mm is cut out into pieces of, e.g., 400 mm in width and 400 mm in length. These green sheet pieces (the foundation substrates 42*a* to 42*d*) are respectively used to prepare the four types of substrates (the protective substrate 41*a*, the main heater substrate 41*b*, the sub heater substrate 41*c*, the base substrate 41*d*) each of which has a thickness of 0.2 mm. Specifically, in order to prepare the main heater substrate 41*b*, the main heat generator 49 and the power supply terminal section 47*b* each containing silver palladium as a main component are formed on a top surface of one of the green sheet pieces by means of screen printing. Thus, the main heat generator 49 and the power supply terminal section 47*b* are integrated into the green sheet piece.

Similarly, in order to produce the sub heater substrate 41*c*, the sub heat generator 48 and the power supply terminal section 47*c* each containing silver palladium as a main component are formed on a top surface of another one of the green sheet pieces by means of screen printing. Thus, the sub heat generator 48 and the power supply terminal section 47*c* are integrated into the green sheet piece. Thereafter, a blanking die is used to form the openings for power supply at respective positions in the green sheet piece for the main heater (the foundation substrate 42*b*) and the green sheet piece for the protective substrate (the foundation substrate 42*a*). Note that it is not necessary to process the green sheet piece for the base substrate (the foundation substrate 42*d*), since the foundation substrate 42*d* does not need a heat generator or an opening, as shown in (*d*) of FIG. 5.

As described previously, a final size of the ceramic heater 41 is 12.3 mm×360 mm×0.8 mm. Thus, a plurality of heaters are formed from one green sheet (400 mm×400 mm). Note that, with the sizes of the present embodiment, one green sheet provides nine ceramic heat generators.

Subsequently, the above four types of green sheet pieces are aligned to each other, and are laminated in the order of the protective substrate 41*a*, the main heater substrate 41*b*, the sub heater substrate 41*c*, and the base substrate 41*d* from the top. After that, the substrates are pressure-bonded (warm isostatic press: WIP) to each other by using a pressing zig. Note that, when the ceramic heater 41 obtained by the pressure-bonding is attached to the retaining member 40, the attaching is performed so that the base substrate 41*d* comes in full contact with the retaining member 40.

Next, the green sheet pieces laminated are cut out into segments each having a predetermined size (12.3 mm×360 mm) by using a die corresponding to contours of a plurality of ceramic heat generators. Then, these segments are put into a heating furnace so as to be baked at a temperature in a range of 800° C. to 900° C. in a non-oxidizing atmosphere. In this manner, it is possible to produce the ceramic heater 41 having the four types of green sheet pieces laminated therein.

(Method for Controlling Fixing)

Next, the following will describe in detail a method for controlling the fixing device 15 of the present embodiment, with reference to FIGS. 1 and 3. As shown in FIG. 1, the power source 53 for heating the ceramic heater 41 includes two voltage-variable power sources 53*a* and 53*b* respectively for the main heater and the sub heater. Through the openings for power supply formed at both ends of the ceramic heater 41, the power supply terminal sections 47*b* of the main heater substrate 41*b* are connected with the voltage-variable power source 53*a* for the main heater, whereas the power supply terminal sections 47*c* of the sub heater substrate 41*c* are connected with the voltage-variable power source 53*b* for the sub heater. Thus, predetermined electric powers are individually supplied to the main heat generator 49 and the sub heat generator 48.

Note that, in the present embodiment, a rated output (electric power) of the ceramic heater 41 is 1,200 W in total, including a rated output of 750 W of the main heater substrate and a rated output of 450 W of the sub heater substrate. Thus, the two voltage-variable power sources 53*a* and 53*b* supply to the ceramic heater 41 an electric power of 1,200 W at maximum, so that the ceramic heater 41 generates heat. A heat energy generated by the ceramic heater 41 is transmitted to the fixing belt 32 via the retaining member 40.

The thermistor 35A and 35B, each of which is temperature detecting means, are provided for a surface of the fixing belt 32, and the thermistor 35C, which is temperature detecting means, is provided for a surface of the pressure roller 31. The thermistors 35A, 35B, and 35C each detect a surface temperature of a subject to be detected. Note that positioning of the thermistors 35A, 35B, and 35C in a longitudinal direction of the fixing device 15 is as follows: the thermistor 35A is disposed in a position corresponding to the main heat-generating area B of the main heat generator 49; the thermistor 35B is disposed in a position corresponding to the main heat-generating areas D and F of the sub heat generator 48; and the thermistor 35C is disposed in a center. According to data of temperatures detected by the thermistors 35A, 35B, and 35C, a control circuit (not illustrated), which is temperature control means, controls electric powers to be supplied (energization) to the main heater substrate 41*b* of the ceramic heater 41, the sub heater substrate 41*c* of the ceramic heater 41, and the heater lamp 34 so that the surface temperatures of the fixing belt 32 and the pressure roller 31 are set to a predetermined temperature. Note that, in the present embodiment, non-contact type thermistors are used for the thermistors 35A, 35B, and 35C.

In the present embodiment, the main heat-generating area B of the main heater substrate 41*b* and the sub heat-generating area E of the sub heater substrate 41*c* are each formed to have a size (200 mm) corresponding to a shorter side length of an A4-size. Therefore, by performing the control as above, heating can be performed suitably as follows: For example, in a case where a wide paper sheet is fed such as when an A3 paper sheet is fed by longitudinal feeding or when an A4 paper sheet is fed by lateral feeding, both of the main heat generator 49 and the sub heat generator 48 are driven. Consequently, the whole of a sheet-passing area through which the wide paper sheet passes through is heated. On the other hand, in a case where a narrow paper sheet is fed such as when an A4 paper sheet is fed by longitudinal feeding or when a B5 paper sheet is fed by longitudinal feeding, only the main heat generator 49 is driven. Consequently, the main heat-generating area B of the main heater substrate 41*b* is heated, whereas the sub heat-generating area A and C are hardly heated. Further, in this case, the sub heater substrate 41*c* does not generate heat. This prevents an abnormal temperature increase of non-sheet-passing areas (areas corresponding to the sub heat-generating areas A and C).

(Heating Properties of Fixing Belt)

Next, with regard to heating properties of the fixing belt 32, a simulation was performed by means of a two-dimensional heat conduction analysis. Specifically, this simulation assumed four types of fixing belts 32 having different heat conductivities as shown in Table 1, and also assumed that an initial temperature of each fixing belt 32 (a temperature measured just before the fixing belt 32 came in contact with a heating member) was 160° C. On these assumptions, a relationship between (i) a temperature of the heating member 33 and (ii) a heating time each of which were necessary to heat each fixing belt 32 to 190° C. in a heating nip area was worked out.

TABLE 1

| | Heat Conductivities (W/mk) | | | |
|---|---|---|---|---|
| Fixing Belt Type | Releasing Layer (PFA Tube, 20 μm) | Elastic Layer (Si Rubber, 150 μm) | Substrate (PI, 70 μm) | Total (240 μm) |
| A | 0.251 | 0.1 | 0.5 | 0.140 |
| B | 0.251 | 0.4 | 0.5 | 0.404 |
| C | 0.251 | 0.8 | 0.5 | 0.589 |
| D | 0.251 | 1.2 | 0.5 | 0.696 |

Figure 6:
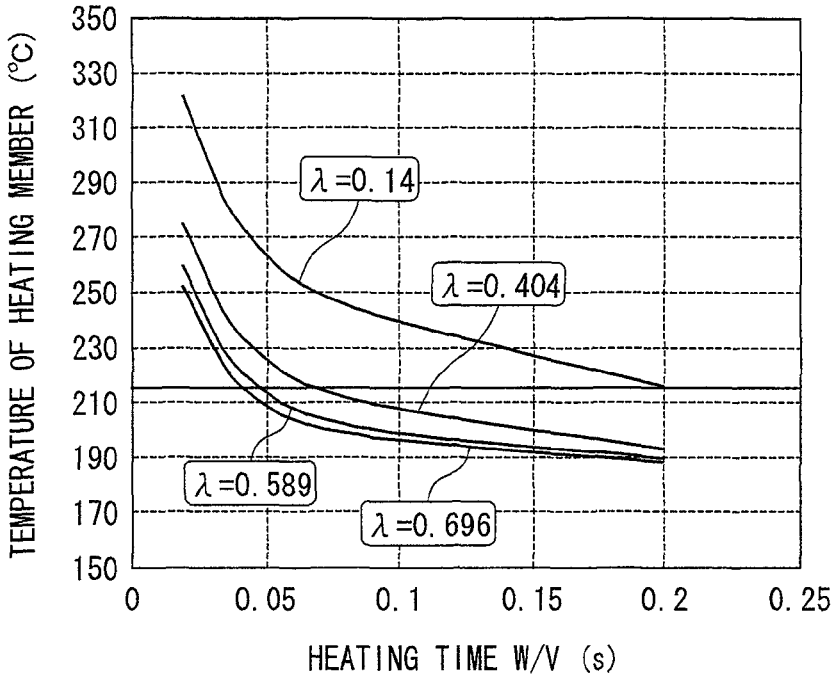
FIG. 6 is a graph illustrating a relationship between a temperature of the heating member and a heating time, which relationship was observed with different heat conductivities λ of the fixing belt.

As shown in Table 1, the heat conductivities λ of the four types of fixing belts 32 were set as follow: The heat conductivities of the releasing layers (PFA tubes) and the substrates (polyimide) were set to be the same, and only the heat conductivities λ of the elastic layers (silicon rubber) were made different. FIG. 6 shows a graph illustrating a relationship between (i) a temperature of the heating member 33 and (ii) a heating time. Here, the heating time can be expressed by W/V (s), where W is a heating nip width (mm) of the heating member 33 and V is a carrying speed (fixing speed) (mm/s) of the fixing belt 32. FIG. 6 shows that, as the heating time W/V (s) becomes shorter, a control temperature of the heating member should be set to be higher. At the same time, FIG. 6 shows that, as the heat conductivity λ of the fixing belt becomes higher, the control temperature of the heating member can be set to be lower.

Figure 7:
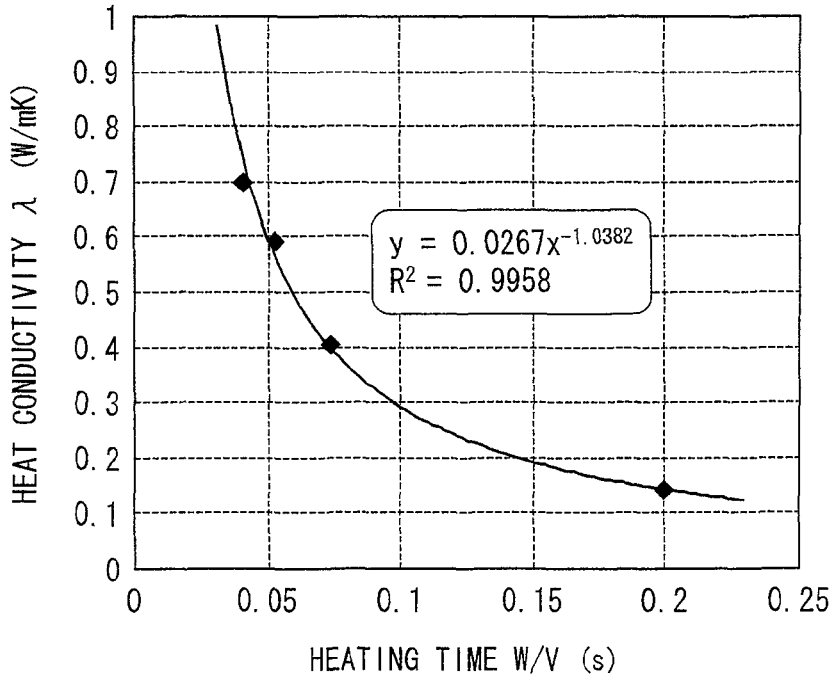
FIG. 7 is a graph illustrating a relationship between a heat conductivity λ and a heating time.

Here, the retaining member 40 of the heating member 33 is made of aluminum. Therefore, if the temperature exceeds 215° C., creeping occurs. That is, the heating member 33 has a heatproof temperature of 215° C. In consideration of this, a relationship between (i) a heating time W/V necessary for heating the fixing belt 32 while preventing a temperature of the heating member 33 from exceeding 215° C. and (ii) a heat conductivity λ of the fixing belt 32 is shown in a graph of FIG. 7. From this, an expression representing this relationship can be approximated by the following Expression (1):

$$\lambda=0.0267\times(W/V)^{-1.0382} \quad (1)$$

Accordingly, by setting the heat conductivity λ of the fixing belt 32 and the heating nip width W of the heating member 33 so that the following Expression (2) is satisfied, it is possible to heat the heating member 33 while preventing a temperature of the heating member 33 from exceeding the heatproof temperature (215° C.).

$$\lambda\geqq 0.0267\times(W/V)^{-1.0382} \quad (2)$$

Figure 8:
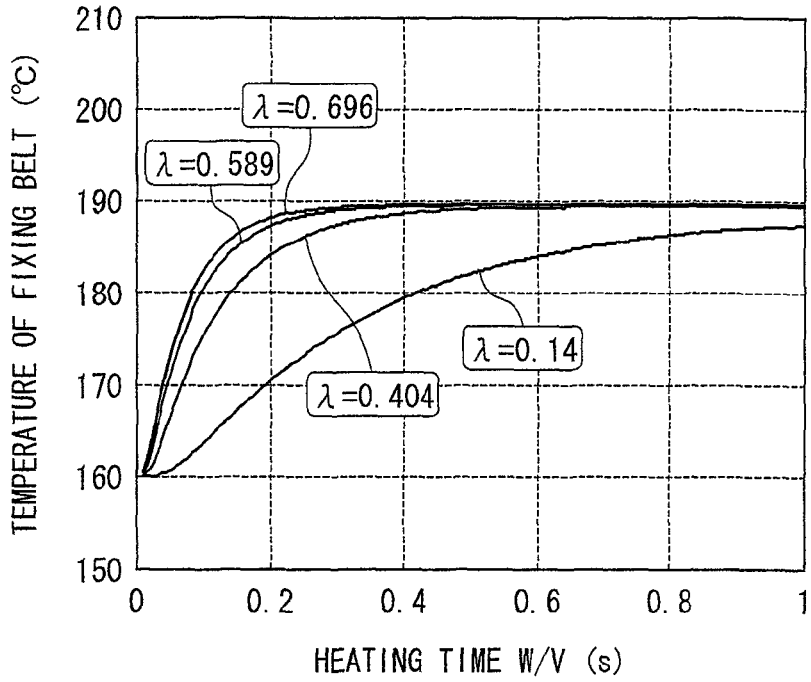
FIG. 8 is a graph illustrating changes in a temperature of the fixing belt in a heating nip area, observed when a control temperature of the heating member was set to 190° C.

Next, a simulation was performed to study a heat conductivity λ of a fixing belt and an upper limit of a heating nip width W of a heating member. FIG. 8 is a graph showing a result of calculation of changes in temperature of each fixing belt 32 in the heating nip area, wherein a control temperature of the heating member 33 was set to 190° C. Note that, as described previously, the heating member 33 was controlled based on temperatures detected by the thermistors 35A and 35B.

FIG. 8 shows the followings: A temperature of each of the fixing belts 32 ultimately reached 190° C., which was the control temperature of the heating member 33, and the temperature did not increase any further; however, a time taken for reaching this state varied depending on the heat conductivity λ of the fixing belt 32. Here, once the temperature of the fixing belt 32 reaches the above state, there is no point in further heating the fixing belt 32 by the heating member 33. In view of this, adopting a concept of a time constant, the present embodiment defines a time taken for heating the fixing belt 32 by 63% as an effective heating time to (s), wherein the temperature at which the above state is attained is 100%, so that setting the heating nip width W to satisfy the following Expression (3) prevents a case where a heating capacity of the heating member 33 is increased due to an unnecessarily large heating nip width W.

$$W/V\leqq te \quad (3)$$

Figure 9:
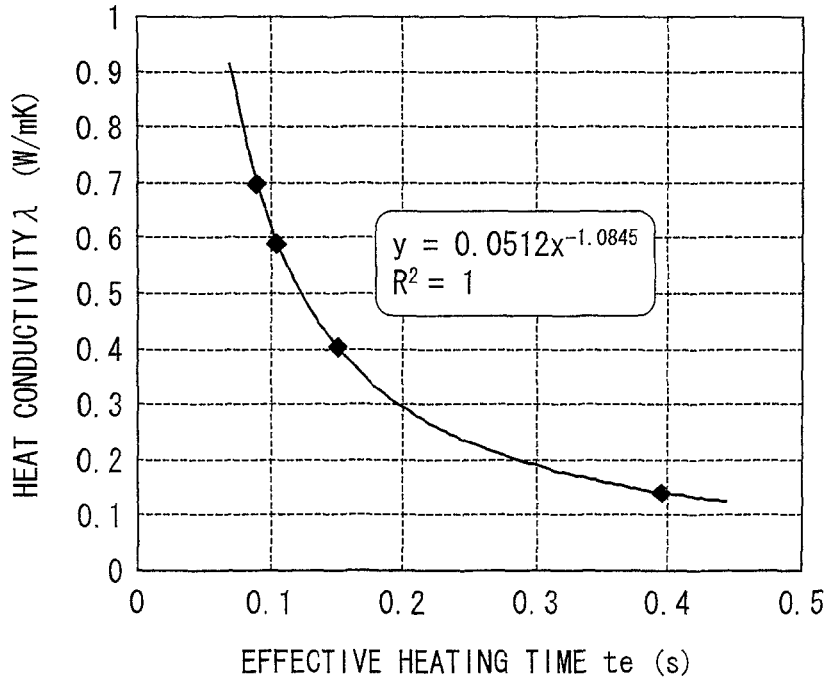
FIG. 9 is a graph illustrating a relationship between a heat conductivity λ and an effective heating time te.

Now, as described above, the effective heating time te (s) varies depending on the heat conductivity λ (W/mK) of the fixing belt 32. Therefore, according to the result in FIG. 8, a relationship between λ and te is shown in a graph of FIG. 9. From this, this relationship can be approximated by the following Expression (4):

$$\lambda=0.0512\times te^{-1.0845} \quad (4)$$

Thus, according to Expressions (3) and (4), setting the heating nip width W of the heating member so as to satisfy the following Expression (5) prevents the heating nip width W from being set to be unnecessarily large.

$$\lambda\leqq 0.0512\times(W/V)^{-1.0845} \quad (5)$$

Expressions (2) to (5) are combined into the following Expression (6):

$$0.0267\times(W/V)^{-1.0382}\leqq\lambda\leqq 0.0512\times(W/V)^{-1.0845} \quad (6)$$

By satisfying the conditions defined by Expression (6), it is possible to define the heating nip width W of the heating member 33 to a minimum value. This prevents the heating capacity of the heating member 33 from being unnecessarily large. In addition, this prevents the temperature of the heating member 33 from increasing to an abnormal level, while reducing a warm-up time.

Note that the heating nip width W is a width in which the heating member 33 and the fixing belt 32 are in contact with each other. Therefore, the heating nip width W is not affected by the fixing speed V. Even if the heating nip width W stays constant, varying the fixing speed V varies the heating time W/V.

In the present embodiment, the fixing belt 32 has a heat conductivity λ of 0.589 (W/mK) and a fixing speed V of 225 mm/s. Therefore, according to Expression (2), the following expression is established:

$$W\geqq V\times(0.0267/\lambda)\hat{}(1/1.0382)\geqq 11.4\ (\text{mm}).$$

Further, according to Expression (3), the following expression is established:

$$W\leqq V\times(0.0512/\lambda)\hat{}(1/1.0845)\leqq 23.7\ (\text{mm})$$

Note that the mark "^" in each of the above expressions represents exponentiation. Thus, the heating nip width W is set to 17.5 mm, which is an intermediate value between 11.4 mm and 23.7 mm.

(Configuration of the Present Invention)

As described previously, a fixing device of the present invention includes: a fixing member; a heating member; a fixing belt which is endless, the fixing belt being rotatably suspended by the fixing member and the heating member, the fixing belt being heated by the heating member; and a pressure member pressing the fixing member via the fixing belt, the pressure member forming, in an area where the pressure member presses the fixing member, a fixing nip area together with the fixing belt, the fixing device fixing an unfixed image on a recording material onto the recording material, while the recording material passes through the fixing nip area, the heating member including: a retaining member having (i) a convex surface which is curved and is in contact with an inner surface of the fixing belt and (ii) a flat surface which is opposite to the convex surface; and a ceramic heater provided on the flat surface of the retaining member.

The above configuration provides excellent safety. Further, the above configuration also provides excellent heat conductivity, thereby reducing a warm-up time. Furthermore, with the above configuration, the ceramic heater does not directly slide with the fixing belt. This elongates lives of the ceramic heater and the fixing belt.

In addition to the above configuration, the fixing device of the present invention may satisfy the following relational expression:

$$0.0267\times(W/V)^{-1.0382}\leqq\lambda\leqq 0.0512\times(W/V)^{-1.0845}$$

where V represents a fixing speed (mm/s); W represents a width (mm) in which the heating member and the fixing belt are in contact with each other; and λ represents a heat conductivity (W/mK) of the fixing belt.

According to this, by setting a relationship between (i) the heat conductivity λ of the fixing belt, (ii) the fixing speed, and (iii) the width W in which the heating member and the fixing belt are in contact with each other so as to satisfy the above range, it is possible to set the heating nip width of the heating member to a minimum value. That is to say, the heating member having a minimum heating nip width is produced, and this avoids inefficiency and prevents a heat capacity of the heating member from being unnecessarily large. This prevents a temperature of the heating member from increasing to an abnormal level, while further reducing a warm-up time.

In addition to the above configuration, in the fixing device of the present invention, the retaining member may have a curvature radius larger than that of the fixing member.

It is difficult to bring a ceramic heater having a flat shape into close contact with the fixing belt. In view of this, in the above configuration, the retaining member is set to have a curvature radius larger than that of the fixing member, and the convex surface of the retaining member is brought into contact with the fixing belt. This allows the heating member to be in close contact with the fixing belt, thereby increasing a heat transfer efficiency to the fixing belt.

In addition to the above configuration, in the fixing device of the present invention, the retaining member may be made of a material having a high heat conductivity.

With the above configuration, the retaining member is made of the material having a high heat conductivity. This makes it possible to efficiently transfer, to the fixing belt, heat generated by the ceramic heater. Here, the material having a high heat conductivity may be metal.

In addition to the above configuration, the fixing device of the present invention may further include: a reinforcement member for preventing the heating member from being bent due to tension of the fixing belt.

A heating member having a small heat capacity may have a low mechanical strength, and accordingly may be bent due to tension of the fixing belt. This may result in a case where the heating member is not in close contact with the fixing belt. In order to avoid this, the above configuration includes the reinforcement member for preventing the bending, thereby preventing the heating member from being bent. Consequently, the above configuration can provide a fixing device which withstands long-term use.

In addition to the above configuration, the fixing device of the present invention may further include: a heat insulating member provided between the heating member and the reinforcement member.

With the above configuration, the heat insulating member is provided between the heating member and the reinforcement member. This prevents a case where a heat efficiency is reduced due to release of heat of the heating member to the reinforcement member.

In addition to the above configuration, in the fixing device of the present invention, the heat insulating member may be made of silicon rubber or fluororubber.

With the above configuration, since the heat insulating member is silicon rubber or fluororubber, the heat insulating member is excellent in heat resistance and heat insulating properties. Thus, silicon rubber and fluororubber are suitable for the heat insulating member.

In addition to the above configuration, in the fixing device of the present invention, the retaining member may include a coating layer on the convex surface which is in contact with the fixing belt. Thus, by providing the coating layer to the retaining member, it is possible to improve sliding properties of the fixing belt.

In order to solve the foregoing problems, an image forming apparatus of the present invention includes any of the fixing devices of the present invention. With this configuration, it is possible to provide an image forming apparatus including a fixing device which is excellent in safety and which has a reduced warm-up time.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims. Further, the present invention encompasses a value range other than the value ranges described above, as long as the value range is a reasonable range that is not contradictory to the purpose of the present invention.

INDUSTRIAL APPLICABILITY

The present invention is applicable to fixing devices included in image forming apparatuses employing an electrophotographic printing method, such as printers, copying machines, facsimiles, and multi function printers (MFP).

REFERENCE SIGNS LIST

| | |
|---|---|
| 15 | Fixing Device |
| 30 | Fixing Roller (Fixing Member) |
| 31 | Pressure Roller (Pressure Member) |
| 32 | Fixing Belt |
| 33 | Heating Member |
| 35a, 35b, 35c, 35d | Thermistors |
| 40 | Retaining Member |
| 40a | Coating Layer |
| 41 | Ceramic Heater |
| 41a | Protective Substrate |
| 41b | Main Heater Substrate |
| 41c | Sub Heater Substrate |
| 41d | Base Substrate |
| 42a to 42d | Foundation Substrates (Insulating Substrates) |
| 48 | Sub Heat Generator |
| 49 | Main Heat Generator |
| 50 | Heat Insulating Sheet (Heat Insulating Member) |
| 51 | Holding Member (Reinforcement Member) |
| 53 | Power Source |
| 53a | Voltage-Variable Power Source for Main Heater |
| 53b | Voltage-Variable Power Source for Sub Heater |
| 100 | Image Forming Apparatus |
| W | Heating Nip Width |
| N | Fixing Nip Area |
| P | Recording Paper Sheet |
| T | Toner |

The invention claimed is:

1. A fixing device comprising:

a fixing member;

a heating member;

a fixing belt which is endless, the fixing belt being rotatably suspended by the fixing member and the heating member, the fixing belt being heated by the heating member; and a pressure member pressing the fixing member via the fixing belt, the pressure member forming, in an area where the pressure member presses the fixing member, a fixing nip area together with the fixing belt, the fixing device fixing an unfixed image on a recording material onto the recording material, while the recording material passes through the fixing nip area, the heating member including:

a retaining member having (i) a convex surface which is curved and is in contact with an inner surface of the fixing belt and (ii) a flat surface which is opposite to the convex surface; and a ceramic heater provided on the flat surface of the retaining member.

2. The fixing device as set forth in claim 1, wherein:

the fixing device satisfies the following relational expression:

$$0.0267\times(W/V)^{-1.0382}\leqq\lambda\leqq0.0512\times(W/V)^{-1.0845},$$

where V represents a fixing speed (mm/s); W represents a width (mm) in which the heating member and the fixing belt are in contact with each other; and λ represents a heat conductivity (W/mK) of the fixing belt.

3. The fixing device as set forth in claim 1, wherein:

the retaining member has a curvature radius larger than that of the fixing member.

4. The fixing device as set forth in claim 1, wherein:

the retaining member is made of a material having a high heat conductivity.

5. The fixing device as set forth in claim 1, further comprising:

a reinforcement member for preventing the heating member from being bent due to tension of the fixing belt.

6. The fixing device as set forth in claim 5, further comprising:

a heat insulating member provided between the heating member and the reinforcement member.

7. The fixing device as set forth in claim 6, wherein:

the heat insulating member is made of silicon rubber or fluororubber.

8. The fixing device as set forth in claim 1, wherein:

the retaining member comprises a coating layer on the convex surface which is in contact with the fixing belt.

9. The fixing device as set forth in claim 1, wherein:

the ceramic heater comprises:

a main heater substrate having a first heat-generating area provided with a main heat generator, the first heat-generating area corresponding to an area of the fixing nip area through which area a recording material of a predetermined size passes; and a sub heater substrate having a second heat-generating area provided with a sub heat generator, the second heat-generating area corresponding to an area of the fixing nip area through which area the recording material of the predetermined size does not pass.

10. An image forming apparatus comprising a fixing device as set forth in claim 1.

* * * * *